United States Patent [19]

Salvino

[11] 4,206,885

[45] Jun. 10, 1980

[54] PORTABLE DEVICE FOR SUPPORTING A ROLL OF SHEETING FOR DISPENSING

[76] Inventor: Lawrence P. Salvino, 285 Milton Rd., Waucanda, Ill. 60084

[21] Appl. No.: 54,158

[22] Filed: Jul. 2, 1979

[51] Int. Cl.[2] ..... B65H 25/02; B65H 17/12

[52] U.S. Cl. ..... 242/55; 242/68.7

[58] Field of Search ..... 242/68.7, 55, 55.2, 242/76, 78.7, 129; 206/386

[56] References Cited

U.S. PATENT DOCUMENTS

| | | | |
|---|---|---|---|
| 1,854,033 | 4/1932 | Hudson | 242/68.7 |
| 2,134,656 | 10/1938 | Breth | 242/68.7 |
| 2,220,230 | 11/1940 | Gilbert | 242/68.7 |
| 2,833,489 | 5/1958 | Hall | 242/78.7 |
| 4,094,473 | 6/1978 | Salvino | 242/55 |

*Primary Examiner*—Edward J. McCarthy
*Attorney, Agent, or Firm*—Rummler & Snow

[57] ABSTRACT

A portable, lightweight device for supporting a roll or coil of sheeting having a stationary, lower, arcuate-shaped, inverted U-shaped channel member supported on a base and an upper arcuate-shaped channel member shiftable with respect to the lower member, adjustable means for locking the upper member on the roll of sheeting to retain it between the channel members and lateral adjustable means to retain said roll in the members.

8 Claims, 7 Drawing Figures

PORTABLE DEVICE FOR SUPPORTING A ROLL OF SHEETING FOR DISPENSING

BACKGROUND OF THE INVENTION

The field of invention is a cradle for supporting and maintaining a roll or coil of sheeting for use in making on-site gutters whereby the aluminum will be kept clean.

This invention is an improvement of the invention shown and described in my U.S. Pat. No. 4,094,473 issued June 13, 1978, and my patent application Ser. No. 16,450 filed Mar. 1, 1979.

SUMMARY OF THE INVENTION

A lightweight, portable dispensing device for a roll of metal sheeting having a lower, stationary, inverted, U-shaped concave channel having positioning means, a convex channel positioned above and in alignment with the concave channel, and means for adjustably retaining the convex channel against the upper surface of a roll of sheeting positioned on the concave channel and means on said concave channel for preventing lateral shifting of the roll of sheeting.

DETAILED DESCRIPTION OF THE DRAWINGS

Figure 1:
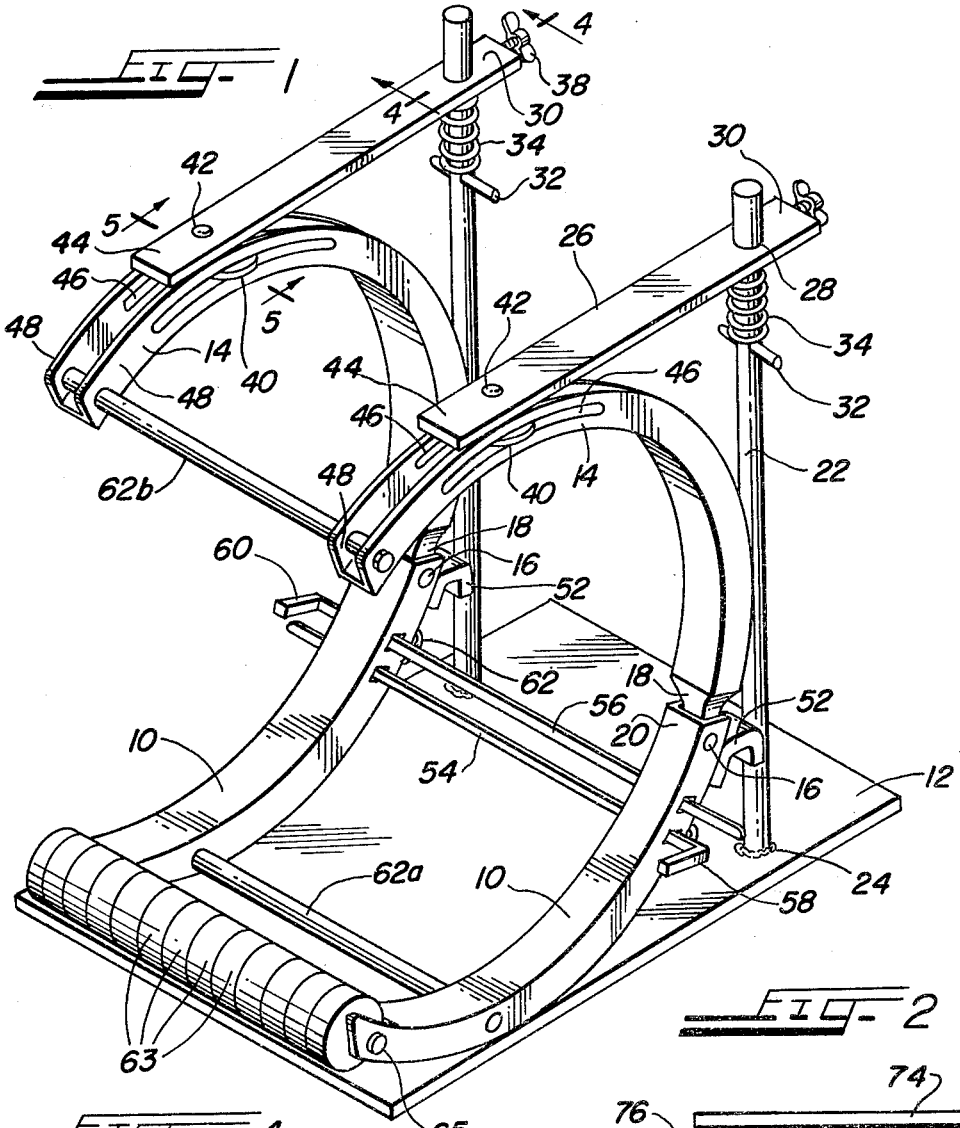
FIG. 1 is a perspective view of the device of the present invention.

In the drawings where the stationary, concave-shaped, inverted, U-shaped channels, the movable convex-shaped channels, the post with its appendates and the plate arms and their appendages are identical, only one of each will be described and only one set of numerals will be used but it should be understood the same numerals apply to the identical parts.

The device of FIG. 1 discloses a single pair of arcuate channels, one above the other, with a post anchored to an enlarged base and having an arm for retaining a roll of sheeting in roll form within the channels, and a pair of transverse arms to prevent lateral movement of the roll in the channels.

Figure 4:
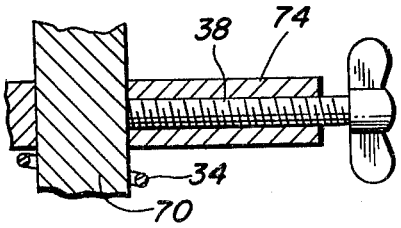
FIG. 4 is a cross-sectional view taken on the line 4—4 of FIG. 1 but with the thumbscrew in locking position.

The spaced, stationary, inverted, U-shaped, concave channel members 10 are anchored to the base 12 by any suitable means such as by welding, and the spaced, convex channels 14 are pivotally secured as at 16 to said concave channels. It is noted the end 18 is offset or reduced in size to readily be inserted between the side walls of the channel 10 at the end 20 of the concave channel member 10. A vertical post 22 is secured to the base 14 at one end by welding or the like 24. An arm 26 is provided with an aperture 28 adjacent one end 30 for slidable positioning on the upper end of post 22. A pin 32 extends through the post 22 and acts as the lower seat for the spring 34. The upper end of spring 34 bears against the lower side of the arm 26 whereby the arm is normally urged upwardly. The end 30 of the arm is bored and threaded edgewise (see FIG. 4) to receive a thumbscrew 38 which will anchor the arm in any desired position on post 22.

Figure 5:
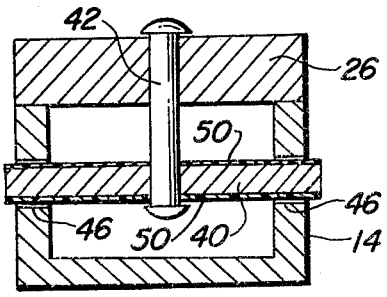
FIG. 5 is a cross-sectional view taken on the line 5—5 of FIG. 1.

A swivel plate 40 is provided with a rod 42 anchored at one end adjacent to outer end 44 of the arm 26. The swivel plate is loosely positioned on the opposite end of rod 42. The swivel plate seats in the arcuate slots 46 in the side legs 48 of the convex member 14. The faces of the swivel plate are preferably lined with a Teflon coating 50 (see FIG. 5) for ease of shifting the member 14 against a roll of sheeting seated on the concave channels 10.

It is to be noted the lower or convex member 10 is also anchored to the post 22 by a U-bracket 52 by, for instance, welding. Also, a pair of spaced, square in cross-section, adjustable rods 54, 56 are slidably seated in the member 10. One end of each of the rods is bent at right angles as at 58, 60, respectively, whereby, when adjusted, will prevent lateral movement of the roll of metal sheeting seated between the members 10, 14. These rods 54, 56 are positioned on the ends of the centered roll of sheeting and anchored in position by any suitable means such as by thumbscrew 62. Spacer rods **62*a* and 62*b* hold the channels 10, 14 in spaced relationship. A series of Teflon rollers 63 are positioned on rod 65 between the forward ends of the channel 10** for ready rotation of the roll of sheeting.

Figure 2:
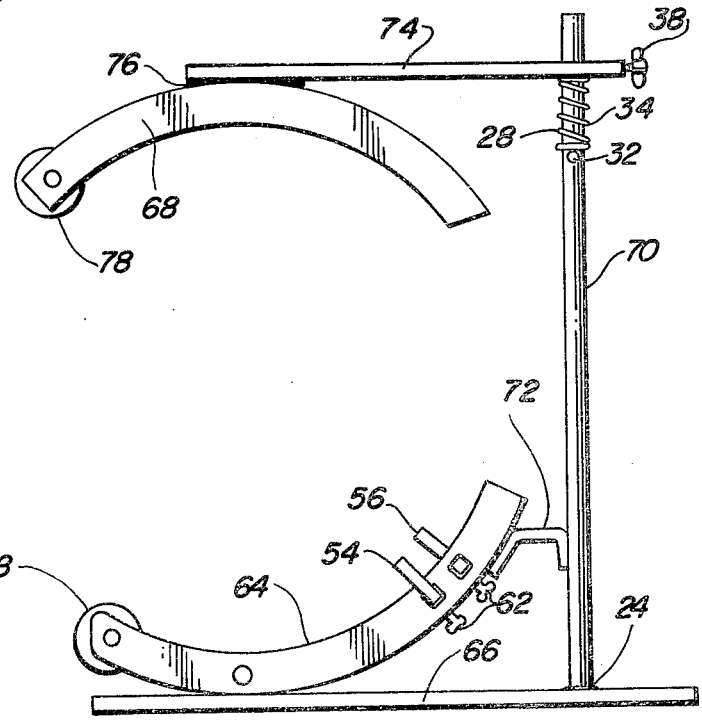
FIG. 2 is a side elevational view of a modified form of the invention.

In the modification of FIG. 2, a single, wide, concave channel member 64 is anchored to a wide base 66 by any suitable means, such as welding. A U-shaped convex channel member 68 is aligned above the concave member.

The concave member 64 is anchored to a vertically extending post 70 by U-shaped bracket 72 and by any suitable means, such as by welding.

The post is identical to one post 22 of FIG. 1, as well as the appendages thereon, including the arm 74 and its locking screw 38, as well as the guide members 54, 56, and will not be discussed in detail, in exception being that the arm 74 and convex member 68 are welded together as at 76, suspending from the arm 74 for positioning on the roll of sheeting.

A Teflon roller 78 is anchored between the free ends of the convex and concave channel members 64, 68 for ready rotation of a roll of sheeting.

Figure 3:
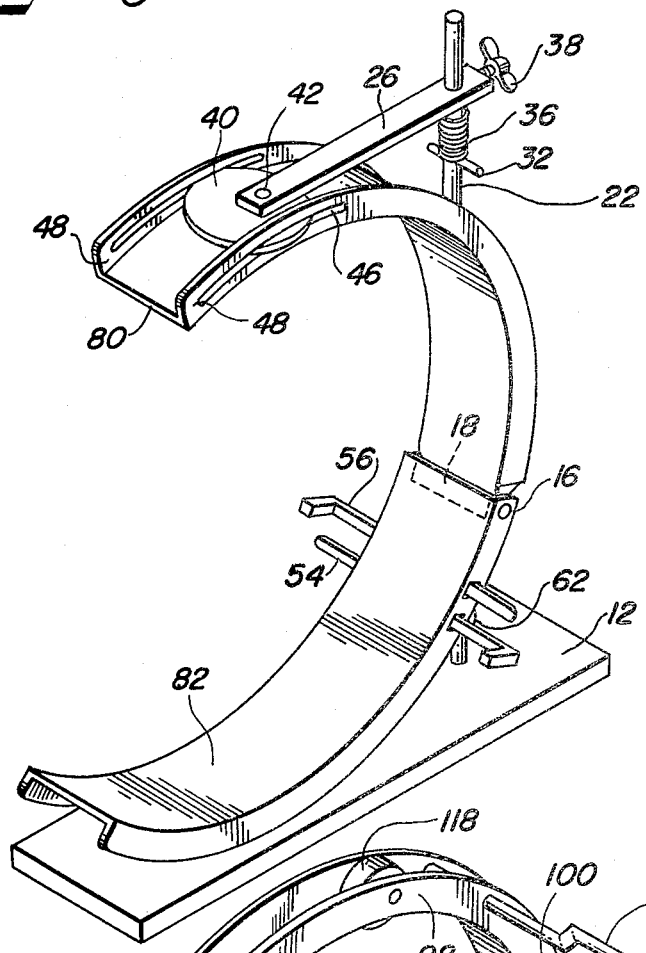
FIG. 3 is a perspective view of another modification of the device of FIG. 1.
Figure 7:
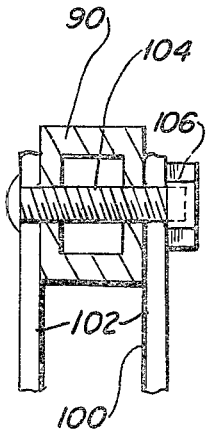
FIG. 7 is a cross-sectional view taken on the line 7—7 of FIG. 6.
Figure 6:
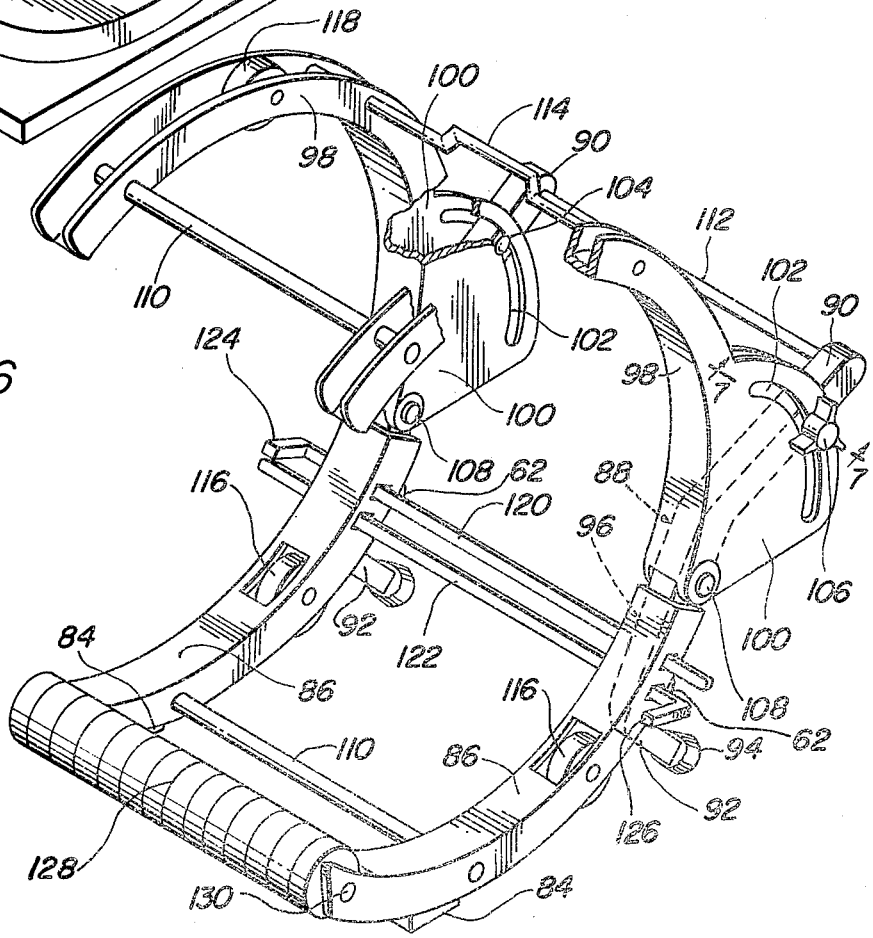
FIG. 6 is a perspective view of still another modification with parts in cross-section.

The Third Modification:

The modification shown in FIG. 3 is substantially identical to that shown in FIG. 1 except that only one convex and concave-shaped channel 80, 82, respectively, are used. The channels are pivotally secured together in the manner as shown in FIG. 1. This modification has the same base 12, post 22 with appendages 32, 34, 38 and 42, swivel plate 40 and its appendages, slot 46, and laterally extending square rods 54, 56, all as shown in FIG. 1. Therefore the same numbers are applied.

This modification operates the same way and functions the same as the other forms of this invention.

The Fourth Modification:

In this modification, the device is substantially identical to the device of FIG. 1 except the vertical powt 22 and its appendages, arm 26 and its appendage, base 12, and U-bracket 52 are not used. As each side of the device is the same, only one set of numerals will be used.

This device employs pads 84 on both inverted, U-shaped, concave channels 86 and is supported by bars 88. The upper portions 90, as shown in the drawing, are bent upwardly and rearwardly while the lower portion 92 are bent downwardly and rearwardly to form, with the pads 84, the support for the device. The lower ends 92 are provided with rubber feet 94. The center sections 96 of the bars 88 are inserted interiorally of the side walls of the channels 86 and welded therein.

The rearward ends of the channels 98 are provided with a pair of V-shaped plates 100 with the upper end being arcuate-shaped and each having arcuate slots 102 for the reception of a threaded bolt 104. A cap 106 is positioned on the shank to selectively anchor the channel 88 on a roll of sheeting.

The channels 98 are pivotally secured to the medial portion 96 of the bar 88 by pivots 108. The channels 98 are positioned above the channels 86 and each channel is held in spaced position by a spacer rod 110 as are the bars 88 by a spacer rod 112. The channels 98 are also provided with a handle 114 positioned between the channels and anchored thereto.

Both channels 88 and 98 are provided with Nylon rollers 116 and 118, respectively.

This modification is also provided with a pair of spaced square rods 120, 122 slidable in the concave-shaped channel and arranged to each be shifted laterally. The ends 124, 126 are bent at right angles to bear against the ends of the roll of sheeting to keep the roll between the channels. A series of Teflon rollers 128 are mounted on rod 130 and positioned at the forward end of the channels 86. The rollers all help to ease the rotation of the roll of sheeting.

In operation, the convex channels of all modifications are moved upwardly and a roll of sheeting placed on the concave channels. Then the convex channels are shifted downwardly on the roll of sheeting and anchored. The laterally shiftable rods are then placed against the sides of the roll of sheeting to prevent lateral displacement of the roll.

Now the sheeting can be withdrawn to have work performed thereon.

Although several modifications have been shown and described, it will be understood that details of the constructions shown may be altered or omitted without departing from the spirit of the invention as defined by the following claims.

I claim:

1. A device for supporting a roll of aluminum sheeting comprising a base, a relatively wide, stationary, concave-shaped, inverted U-channel lower member anchored to said base, a relatively wide, convex-shaped upper member pivotally secured at one end to one end of said concave member, a vertical post, an arm, one end slidably mounted on the upper end of said post, the opposite end lying against said convex member, whereby said convex arm may be adjusted toward and away from said concave member, means for anchoring one end of said concave member to said post, a pin secured adjacent the upper end of said post, a compression spring on said post between said arm and said pin to normally urge said arm upwardly on said post, and means to lock said arm to said post.

2. The device according to claim 1 wherein a pair of spaced concave members are anchored to said base in spaced relationship and a pair of spaced convex-shaped members are positioned above and in alignment with said concave members and one of each is pivotally secured to one end of each of said concave members, a pair of spaced vertical posts anchored to said base and one positioned adjacent each of said members, means to anchor each of said concave members to one of said posts, a pair of arms slidably mounted on one of each of said posts, compression springs on each of said posts to normally urge said arms upwardly, the free ends of said arms bearing against said convex members, and means to lock said arms to said post.

3. The device according to claim 1 wherein spaced, laterally-shiftable arms are mounted on said lower member having one of their ends bent at right angles whereby to retain said coil in said device, and means to latch said rods in any desired position.

4. The device according to claim 2 wherein spaced, laterally-shiftable, adjustable rods are loosely seated in and between said convex arms, one end of each of said arms being bent at right angles to retain a coil of metal sheeting in said device, and means to latch the rods and retain the same in any desired position.

5. The device according to claim 1 whereby a swivel plate is mounted on the free end of said arm to seat in a slot in the convex member.

6. The device of claim 2 wherein the convex members are each provided with opposed slots, swivel plates loosely anchored and depending one from each of said arms and seated in said slots.

7. A device for supporting a roll of aluminum sheeting comprising a base, a relatively wide, stationary, concave-shaped, inverted U-channel lower member anchored to said base, a relatively wide, convex-shaped upper member, a vertical post, an arm, one end slidably mounted on the upper end of said post, the opposite end anchored to said convex member, whereby said convex shaped upper member may be adjusted toward and away from said concave member, means for anchoring one end of said concave member to said post, a pin secured adjacent the upper end of said post, a compression spring on said post between said arm and said pin to normally urge said arm upwardly on said post, and means to lock said arm to said post.

8. A device for supporting a roll of sheeting comprising a pair of spaced, concave-shaped, inverted U-channels on which said roll is seated, a pair of bracket members, one secured to the rear end of each of said channels, the lower end of said brackets being bent downwardly and outwardly to form a stand for the device, a pair of convex-shaped U-channels positioned above said concave channels and each pivotally secured to said brackets and having side walls, a pair of triangular plates having three sides, one of said sides integrally formed one on each of said convex channel walls and extending rearwardly, the second sides of said plates extending outwardly from each of said side walls, the third sides being arcuate, arcuate slots formed in said plates adjacent said third sides, bolt means extending through said plates and having a thumbnut for adjustably anchoring said convex channels against the upper end of the roll of sheeting, a carrying handle extending between and anchored to said convex channels, and adjustable means on said concave channels to prevent lateral movement of the roll of sheeting positioned between said channels.

* * * * *